United States Patent [19]

Palmieri et al.

[11] 4,150,520

[45] Apr. 24, 1979

[54] DEVICE FOR FEEDING ARTICLES

[75] Inventors: Angelo Palmieri, Zola Predosa; Sandro Salicini, Bologna, both of Italy

[73] Assignee: Carle & Montanari S.p.A., Bologna, Italy

[21] Appl. No.: 872,141

[22] Filed: Jan. 25, 1978

[30] Foreign Application Priority Data

Jan. 26, 1977 [IT] Italy ..... 12435 A/77

[51] Int. Cl.[2] ..... B65B 11/28

[52] U.S. Cl. ..... 53/225; 53/234; 53/247; 198/450; 414/744

[58] Field of Search ..... 53/225, 234, 247, 253; 198/450, 449, 480, 689; 214/1 BC, 1 BH

[56] References Cited

U.S. PATENT DOCUMENTS 2,995,234 8/1961 Seragnoli ..... 198/480

FOREIGN PATENT DOCUMENTS 2107744 9/1971 Fed. Rep. of Germany ..... 53/234

814369 6/1959 United Kingdom ..... 53/234

*Primary Examiner*—John Sipos

*Attorney, Agent, or Firm*—Pollock, Vande Sande & Priddy

[57] ABSTRACT

The device for feeding candies to a wrapping machine comprises a first disc on which the candies are discharged in a disorderly manner, which first disc is provided with separating brushes, for causing the candies to be housed in pockets provided thereon. The said pockets are arranged on the discs along arc lengths, the diameter of the said arc lengths being equal to the diameter of the crown of receiving pockets arranged on a second disc, or feeding disc. The candies are transferred from the pockets in the first disc to the pockets of the crown of the second disc by means of an intermediate rotary transfer device, which is provided with grippers each of which takes from the first disc a group of candies arranged along an arc length and deposits said group on a corresponding arc length of the crown of receiving pockets in the second disc.

4 Claims, 4 Drawing Figures

DEVICE FOR FEEDING ARTICLES

BACKGROUND AND SUMMARY OF THE INVENTION

The present invention relates to a device for feeding articles, particularly adapted for feeding articles to a wrapping or packaging machine. More specifically, the invention relates to a device for the feeding of candies, or similar products, to a wrapping machine, of the type in which the candies are discharged in a disorderly manner on a first disc, or conveyor disc, provided with orderly arranged pockets, into which the said candies are arranged by separating and singularizing means. From the pockets of the conveyor disc the candies are transferred to a second disc, which is also called the feeding disc, since it actually feeds the candies to the wrapping machine. The main problem in this type of feeding devices resides in the fact that while the feeding disc which directly feeds the candies to the wrapping machine can operate at high rotational speeds, such as are the speeds which can be attained by the wrapping machine, the conveyor disc necessarily must operate at lower rotational speeds, since the operation of separating and singularizing the candies delivered thereon necessarily takes more time. Therefore, the speed of the feeding disc, and consequently of the whole feeding device, is dependent and conditioned by the speed attainable by the first disc, or conveyor disc.

Of course, higher operational speeds could be attained by making at least the conveyor disc, on which the articles are separated and singularized, of greater dimensions, but it is evident that this would lead to greater overall dimensions of the feeding device, which are not desirable.

It has been proposed by the device as disclosed in the German Pat. 2 107 744 of Sept. 9, 1971, which is the closest prior art known to the applicants, to provide the conveyor disc with concentric crowns of pockets in which the candies are arranged by the separating and singularizing means. The candies thus arranged are then transferred by an intermediate transfer device, in the form of a drum rotating on a horizontal axis and presenting a number of rows of peripheral transferring pockets corresponding to the number of concentric crowns, to the feeding disc, which receives, at each transferring step of the said drum, a number of candies equal to the number of concentric crowns of the first (conveyor) disc. Practically, however, due to reasons of construction and smooth operation, the number of concentric crowns must be limited to two, and therefore the final feeding speed is necessarily limited.

According to the present invention, the speed of the feeding device is greatly increased, by arranging the pockets on the conveyor disc (on which the candies are separated and singularized) in groups or sets in which the pockets are distributed on arc lengths, the arcs having the same diameter as the crown of receiving pockets on the feeding disc. An intermediate rotary transfer device is provided between the two discs, which transfer device presents a plurality of grippers adapted each to take a group of candies from a set of pockets in the conveyor disc, and transfer them without changing their relative position, directly onto a corresponding arc length of the crown of pockets on the feeding disc.

The above and other features and advantages of the feeding device according to the present invention will appear evident from the following detailed description of some preferred embodiments made with reference to the attached drawings.

DESCRIPTION OF THE PREFERRED EMBODIMENT

Figure 1:
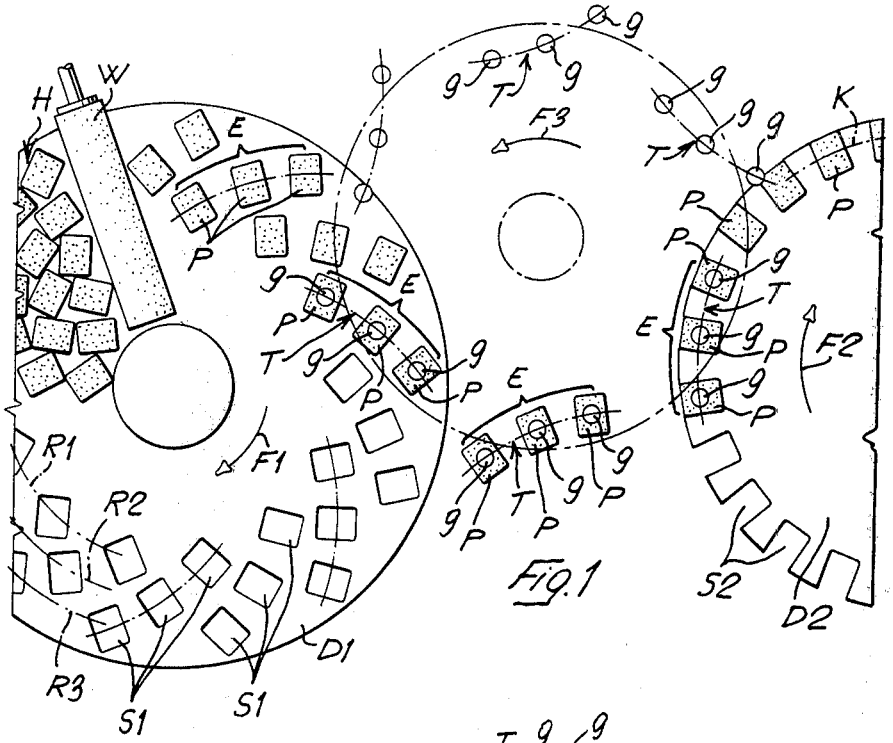
FIG. 1 is a diagrammatic view, from the top, of a first embodiment of a device according to the invention for feeding candies to a wrapping machine.

In FIG. 1 there is diagrammatically shown a feeding device for feeding candies to a wrapping machine. The feeding device consists of a first horizontal disc D1, or conveyor disc, which rotates continuously or intermittently around its vertical axis, in the direction of the arrow F1. The conveyor disc D1 is provided on its upper surface with pockets S1 for receiving the candies P. Each pockets S1 is open at the top and closed at the bottom, and it is adapted for just one candy P. The conveyor disc is constructed as a separating disc, in order to singularize, in a known manner, the candies P which are delivered thereon in a heap H. To this purpose, there is provided for example a rotating brush roller W, which by cooperating with the rotating disc D1, causes each single candy P to fall into a corresponding pocket S1.

At a certain distance from the conveyor disc D1, there is arranged, on the same plane thereof, a second horizontal disc D2, or feeding disc, which presents a peripheral crown of edge pockets S2, each pocket S2 being adapted to receive a single candy P. The feeding disc D2 rotates around its vertical axis in a continuous or intermittent manner, in the direction of arrow F2.

The pockets S1 of the conveyor disc D1 are arranged along three concentrical crowns R1, R2 and R3. Each pocket S1 of one of the said crowns R1, R2, R3 is oriented with respect to a corresponding pocket of the remaining two crowns. The three pockets S1 oriented the one with respect to the other are located on an arc indicated by dash-and-dot line, which arc belongs to a circumference having the same diameter as the crown K of pockets S2 of the disc D2. Also the spacing between the three oriented pockets S1 of the conveyor disc D1 is equal to the spacing of the pockets S2 on the feeding disc D2.

Figure 2:
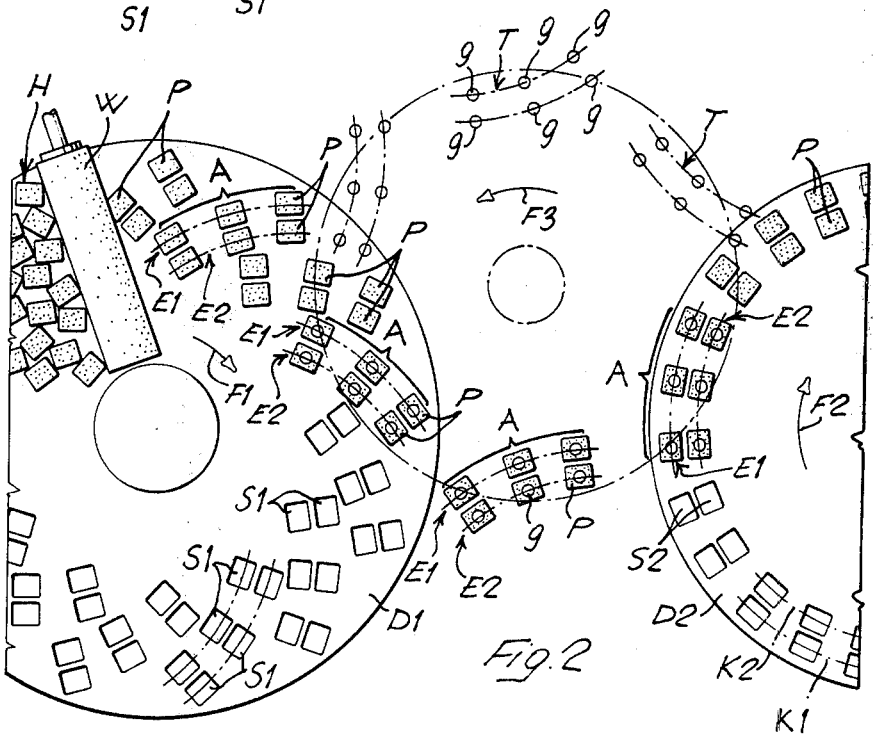
FIG. 2 is a diagrammatic view, from the top, of a second embodiment of the feeding device according to the invention.
Figure 3:
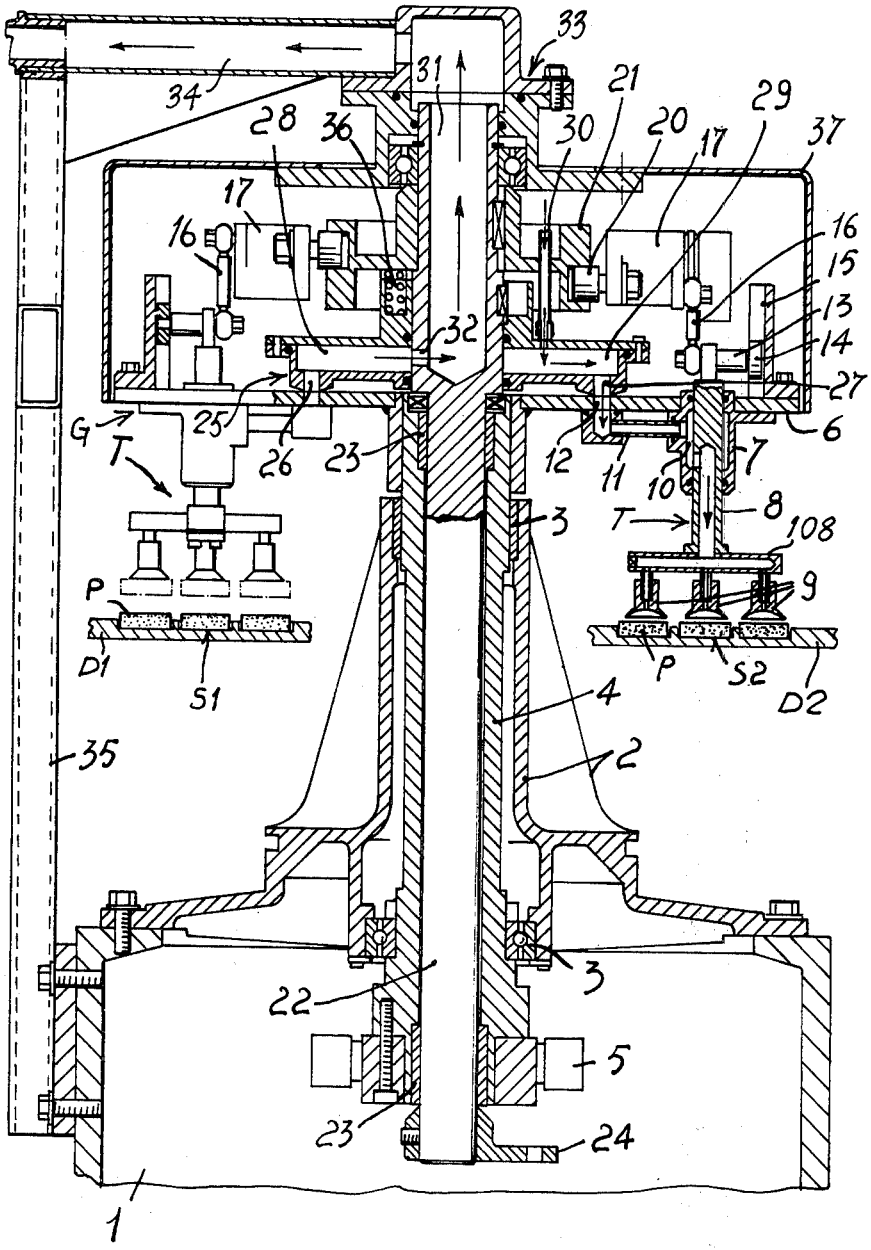
FIG. 3 is a vertical section of the rotary transfer device arranged between the conveyor disc and the feeding disc of the feeding device according to the invention.
Figure 4:
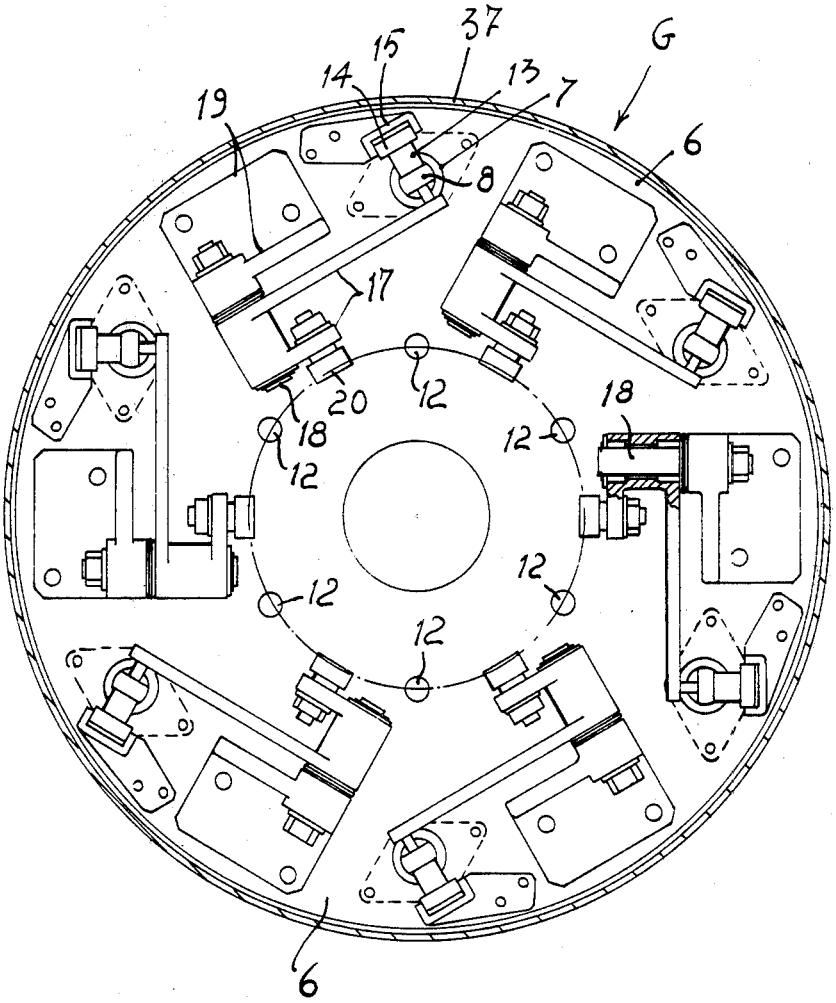
FIG. 4 is a view from the top of the rotary transfer device of FIG. 3.

Between the conveyor disc D1 and the feeding disc D2 there is arranged the rotary transfer device G, diagrammatically indicated in FIGS. 1 and 2 by dash-and-dot lines, which rotary transfer device G rotates continuously or intermittently around a vertical axis, in the direction of arrow F3. The transfer device G, as shown in FIGS. 3 and 4, consists of a vertical hollow shaft 4, which is supported through bearings 3 by the tubular post 2 of the basement 1. The hollow shaft 4 is provided at its lower end with conventional driving means 5, while it carries secured at its upper end a disc 6, which is in overlapping relation with respect to the underlying discs D1 and D2, and which carries downwardly directed grippers T movable up and down, but secured against rotation.

Each gripper T of the rotary transfer device consists of three downwardly directed suction cups 9, which are provided on a horizontal hollow carrier arm 108. The carrier arm 108 presents a vertical hollow stem 8, which is slidable in a vertical guide sleeve 7 of the disc 6. In the guide sleeve 7 there is provided, all around the stem 8, an annular chamber 10, which communicates at one side, through the duct 11, with a bore 12 provided in the disc 6, and at the other side it communicates, through a radial bore in the hollow stem 8 and the hollow carrier arm 108, with the suction cups 9. The bores 12 are angularly equispaced on a circumference which is concentrical to the axis of rotation of the disc 6.

The vertical stem 8 projects through the sleeve 7 above the disc 6 and is provided with a horizontal pin 13 which carries at one end a roller 14, while at its other end it is connected, by means of the link rod 16, with a rocking lever 17. The roller 14 engages a vertical guide 15, secured to the disc 6. This guide 15 allows vertical up and down movements of the stem 8 and of the suction cups 9, but does not permit any rotation of the said stem 8 with respect to the disc 6. The rocking lever 17 can oscillate around a horizontal spindle 18 on a support 19 secured to the disc 6, and is provided with a follower roller 20 which engages the groove of an annular face cam 21.

The annular face cam 21 is secured at the top of a shaft 22, which is driven through the hollow shaft 4 and is housed inside same by means of bearings 23. At its lower end, the shaft 22 is provided with means 24 for controlling its rotational movement.

On the same shaft 22, below the cam 21 there is keyed an annular air distributor 25, which is integral in rotation with the said shaft 22 and can perform axially limited movements, being to this respect urged downwardly by the spring 36 against the disc 6. The air distributor 25 presents a suction chamber 28 and a separate pressure chamber 29, diametrally opposed. The suction chamber 28 is in communication through a radial bore 32, with the duct 31 obtained in the upper section of shaft 22. The duct 31 is connected, with air tight seal and with possibility of rotation, to a top cover 33 which, through a further duct 34 is connected to a vacuum source (not shown). The pressure chamber 28 of the air distributor communicates, through a duct 30, with a source of air under pressure (not shown). The air distributor 25 presents, in correspondence of the suction chamber 28 an arc-shaped suction slot 26, which covers a part of the circumferential bores 12 of the disc 6. Correspondingly, the pressure chamber 29 is provided with an arc-shaped pressure slot 27, which also covers a part of the circumferential bores 12 of the said disc 6. The suction slot 26 is located in correspondence of the conveyor disc D1, while the pressure slot 27 is located in correspondence of the feeding disc D2. A protective casing 37 covers the upper part of the disc 6 of the transfer device G.

In the transfer device G illustrated in FIGS. 3 and 4, the grippers T which rotate together with the disc 6, can be lifted and lowered of predetermined amounts due to limited rotation of shaft 22, through the face cam 21. Moreover, the grippers T can be put in communication with a suction source in correspondence of the conveyor disc D1 and with an air pressure source in correspondence of the feeding disc D2. The suction cups 9 of each gripper T, represented diagrammatically by small circles in FIG. 1, are arranged on a section of arc (dash-and-dot line) which corresponds to the section of arc according to which the pockets S1 of the three concentric crowns R1, R2, R3 of disc D1 are oriented. This section of arc corresponds also to a section of arc of the peripheral crown K of the receiving pockets arranged on the feeding disc D2.

The operation of the device is as follows: At each feeding step, a gripper T is positioned in correspondence of the conveyor disc D1 so as to present its three suction cups 9 exactly over three oriented pockets S1 of the said disc D1. The gripper T is then lowered, through a limited rotation of the shaft 22, so that its suction cups 9 come into contact with the candies P contained in the said three pockets S1. At the same time, the suction cups are connected to the vacuum source, since the suction slot 26 of the air distributor 25 covers the bore 12 on the disc 6, corresponding to the lowered gripper T. Finally, the gripper is lifted due a subsequent rotation of the shaft 22. In this manner, the suction cups 9 of the gripper T take out, due to suction, a set E of three candies, from the pockets S1 of the disc D1.

The lifted gripper T is carried in rotation by the rotary transfer device G in the direction of arrow F3. The suction cups 9 remain in communication with the suction chamber, and the three candies P remain attached to the suction cups during this transfer.

When the gripper T reaches the zone of the feeding disc D2, the three suction cups 9 come to be positioned exactly above three corresponding receiving pockets S2 of the disc D2. The gripper T is now lowered, thanks to a limited rotation of the shaft 22, so that the candies P carried by the said gripper T are lowered inside the receiving pockets S2. At the same time, the air distributor is rotated together with the shaft 22 in such a manner that the pressure or blowing slot 27 comes to cover the bore 12 corresponding to the said gripper T. The suction cups 9 are therefore put into communication with the air under pressure, and the candies P are discharged by a jet of air into the receiving pockets S2 of the disc D2. The gripper T of the transfer device G is then again lifted, and the communication with the pressure slot 27 is interrupted.

MODIFICATION

In the embodiment diagrammatically shown in FIG. 2, the feeding disc D2 presents two concentrical crowns K1 and K2 of receiving pockets S2. The conveyor disc D1 is provided with a plurality of concentrical crowns of pockets S1. At each feeding step, from the conveyor disc D1 there is taken away by the transfer device G a set of candies A, which is composed of two single sets E1 which follow each other in the circumferential direction of the disc, each set E1 being made of three candies P, the said candies being deposited in three subsequent receiving pockets S2 of the two crowns K1 and K2 of the feeding disc D2. The pockets S1 on the conveyor disc D1 are therefore arranged in groups, each group presenting two series of pockets (three) arranged along two arc sections having the same diameter of the circumferences of the crowns K1, K2 of the feeding disc D2, the pockets being spaced between them in an equal manner. The suction cups 9 (represented by small circles) will be in equal number and present the same disposition and spacing. For the rest, the transfer device G presenting the grippers T and the suction cups 9 can be realized in substantially the same manner as the one illustrated in FIG. 3.

It is believed that the invention will have been clearly understood from the foregoing detailed description of some preferred embodiment. Changes in the details of construction, particularly as for what concerns the number and disposition of the pockets on the discs, may be resorted to without departing from the spirit of the invention, and it is accordingly intended that no limitation be implied and that the hereto annexed claims be given the broadest interpretation to which the employed language fairly admits.

We claim:

1. A device for feeding articles, particularly adapted for feeding articles to a wrapping or packaging machine, comprising:

(a) a first disc or conveyor disc, arranged horizontally and rotating about a vertical axis, said conveyor disc presenting a plurality of concentrical crowns of pockets, each pocket of a crown being adapted to receive an article and being arranged on the said conveyor disc, with respect to a corresponding pocket of each one of the other concentric crowns, so as to form a set of pockets arranged on an arc of circumference having a predetermined diameter;

(b) a second disc or feeding disc, arranged horizontally and rotating about a vertical axis, said feeding disc presenting at least one crown of receiving pockets arranged on a circumference having a diameter equal to the said above mentioned predetermined diameter;

(c) rotary transfer device arranged between the said conveyor disc and the said feeding disc, said rotary transfer device comprising a plurality of grippers angularly equispaced and rotating around a vertical axis, each gripper being adapted to take out a set of articles positioned in a set of pockets on the conveyor disc and to deposit same, without modifying the relative position of the articles, in the receiving pockets provided on an arc length of the crown of receiving pockets of the feeding disc.

2. A feeding device according to claim 1, in which each set of pockets on the conveyor disc is composed of three pockets arranged subsequently on an arc length, and the receiving pockets are arranged on a single crown on the feeding disc.

3. A feeding device according to claim 1, in which each set of pockets on the conveyor disc is composed of pockets arranged on two or more concentric arc lengths, and the receiving pockets are arranged on concentric crowns on the feeding disc.

4. A feeding device according to claim 1, in which each gripper of the rotary transfer device comprises a plurality of suction cups, means being provided for alternately connecting said suction cups to a source of vacuum, in order to take the articles out of the pockets in the conveyor disc, and with a source of fluid under pressure, in order to discharge the said articles in the receiving pockets in the feeding disc.

* * * * *